US009915138B2

(12) United States Patent
Schwefe et al.

(10) Patent No.: US 9,915,138 B2
(45) Date of Patent: Mar. 13, 2018

(54) DRILL BIT WITH HYDRAULICALLY ADJUSTABLE AXIAL PAD FOR CONTROLLING TORSIONAL FLUCTUATIONS

(75) Inventors: Thorsten Schwefe, Virginia Water (GB); Chad J. Beuershausen, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 78 days.

(21) Appl. No.: 13/489,563

(22) Filed: Jun. 6, 2012

(65) Prior Publication Data

US 2012/0255788 A1 Oct. 11, 2012

Related U.S. Application Data

(63) Continuation-in-part of application No. 12/248,801, filed on Oct. 9, 2008, now Pat. No. 8,205,686, which is a continuation-in-part of application No. 12/237,569, filed on Sep. 25, 2008, now Pat. No. 7,971,662.

(51) Int. Cl.

| | |
|---|---|
| ***E21B 44/00*** | (2006.01) |
| ***E21B 10/62*** | (2006.01) |
| ***E21B 10/42*** | (2006.01) |

(52) U.S. Cl.

CPC ..... *E21B 44/005* (2013.01); *E21B 10/42* (2013.01); *E21B 10/62* (2013.01)

(58) Field of Classification Search

CPC ..... E21B 7/064; E21B 7/04; E21B 7/06
USPC ..... 175/57, 73, 76, 408
See application file for complete search history.

(56) References Cited

U.S. PATENT DOCUMENTS

| | | | | |
|---|---|---|---|---|
| 3,261,402 | A * | 7/1966 | Whitten | E21B 49/10 166/100 |
| 3,330,164 | A * | 7/1967 | Wilson | E21B 19/164 173/216 |
| 3,422,672 | A * | 1/1969 | Payne | E21B 47/06 175/50 |
| 3,583,501 | A | 6/1971 | Aalund | |
| 4,086,698 | A | 5/1978 | Sparks | |

(Continued)

FOREIGN PATENT DOCUMENTS

| | | | |
|---|---|---|---|
| CN | 1617973 | A | 5/2005 |
| CN | 101578425 | A | 11/2009 |

(Continued)

OTHER PUBLICATIONS

International Search Report and Written Opinion dated Oct. 15, 2013 for International Application No. PCT/US2013/044487; references in PCT are cited above.

(Continued)

*Primary Examiner* — Jennifer H Gay
(74) *Attorney, Agent, or Firm* — Cantor Colburn LLP

(57) ABSTRACT

A drill bit that includes one or more cutters on a surface thereon configured to penetrate into a formation. The drill bit includes at least one pad at the surface, an actuation device configured to supply a fluid under pressure to the pad to extend the pad from the surface. The drill bit also includes a relief device configured to drain fluid supplied to the pad to reduce the pressure on the at least one pad when the force applied on the at least one pad exceeds a selected limit.

21 Claims, 6 Drawing Sheets

(56) References Cited

U.S. PATENT DOCUMENTS 4,102,415 A 7/1978 Cunningham
4,185,704 A 1/1980 Nixon, Jr.
4,262,758 A 4/1981 Evans
4,291,773 A 9/1981 Evans
4,416,339 A 11/1983 Baker et al.
4,471,843 A 9/1984 Jones, Jr. et al.
4,480,703 A * 11/1984 Garrett ..... E21B 33/085 175/195
4,614,148 A * 9/1986 Bates ..... E21B 33/06 251/1.1
4,638,873 A 1/1987 Welborn
4,730,681 A 3/1988 Estes
4,842,083 A 6/1989 Raney
4,856,601 A 8/1989 Raney
4,953,639 A * 9/1990 Hamner ..... E21B 19/086 175/203
5,152,258 A * 10/1992 D'Alfonso ..... F01L 13/06 123/90.12
5,158,109 A 10/1992 Hare, Sr.
5,180,007 A * 1/1993 Manke ..... E21B 23/006 166/240
5,220,963 A 6/1993 Patton
5,293,945 A 3/1994 Rosenhauch et al.
5,341,886 A 8/1994 Patton
5,419,405 A 5/1995 Patton
5,443,565 A 8/1995 Strange, Jr.
5,467,834 A 11/1995 Hughes et al.
5,553,678 A 9/1996 Barr et al.
5,617,927 A * 4/1997 Maissa ..... E21B 49/06 175/40
5,671,816 A 9/1997 Tibbitts
5,941,321 A 8/1999 Hughes
6,012,536 A 1/2000 Puttmann et al.
6,092,610 A 7/2000 Kosmala et al.
6,138,780 A 10/2000 Beuershausen
6,142,250 A 11/2000 Griffin et al.
6,173,797 B1 1/2001 Dykstra et al.
6,209,664 B1 4/2001 Amaudric du Chaffaut
6,253,863 B1 7/2001 Mensa-Wilmot et al.
6,257,356 B1 7/2001 Wassell
6,260,636 B1 7/2001 Cooley et al.
6,290,007 B2 9/2001 Beuershausen et al.
6,321,862 B1 11/2001 Beuershausen et al.
6,349,780 B1 2/2002 Beuershausen
6,568,470 B2 5/2003 Goodson, Jr. et al.
6,659,200 B1 * 12/2003 Eppink ..... E21B 4/18 166/381
6,670,880 B1 12/2003 Hall et al.
6,725,947 B2 4/2004 Palaschenko et al.
6,840,336 B2 1/2005 Schaaf et al.
6,971,459 B2 12/2005 Raney
7,090,037 B2 8/2006 Best
7,198,119 B1 4/2007 Hall et al.
7,201,237 B2 4/2007 Raney
7,287,604 B2 10/2007 Aronstam et al.
7,373,995 B2 5/2008 Hughes et al.
7,413,034 B2 * 8/2008 Kirkhope et al. ..... 175/76
7,419,016 B2 9/2008 Hall et al.
7,484,576 B2 2/2009 Hall et al.
7,493,967 B2 * 2/2009 Mock et al. ..... 175/57
7,971,662 B2 * 7/2011 Beuershausen ..... E21B 10/20 175/408
2002/0011358 A1 1/2002 Wassell
2002/0088648 A1 7/2002 Krueger et al.
2002/0100617 A1 8/2002 Watson et al.
2002/0104686 A1 * 8/2002 Bloom ..... E21B 4/18 175/99
2002/0108487 A1 * 8/2002 Yuratich ..... E21B 47/01 91/508
2002/0112887 A1 8/2002 Harrison
2004/0238221 A1 12/2004 Runia et al.
2005/0023232 A1 2/2005 Henk
2007/0221416 A1 9/2007 Hall et al.
2007/0221417 A1 9/2007 Hall et al.
2007/0235227 A1 * 10/2007 Kirkhope ..... E21B 7/062 175/73
2008/0000693 A1 * 1/2008 Hutton ..... 175/61
2008/0110674 A1 * 5/2008 Jones ..... E21B 7/062 175/25
2008/0223616 A1 * 9/2008 Mock et al. ..... 175/51
2008/0245570 A1 10/2008 Partouche
2009/0044951 A1 2/2009 Milkovisch et al.
2009/0044979 A1 2/2009 Johnson et al.
2009/0090554 A1 * 4/2009 Sugiura ..... E21B 47/08 175/24
2009/0166086 A1 * 7/2009 Sugiura ..... E21B 7/062 175/25
2009/0194334 A1 8/2009 Johnson et al.
2010/0025116 A1 * 2/2010 Hutton ..... E21B 7/06 175/61
2010/0071956 A1 3/2010 Beuershausen
2010/0071962 A1 3/2010 Beuershausen
2010/0126770 A1 * 5/2010 Sugiura ..... E21B 7/062 175/38
2011/0049901 A1 * 3/2011 Tinnen ..... E21B 41/0085 290/54
2012/0037063 A1 * 2/2012 Backes ..... B63B 35/32 114/312
2012/0067593 A1 * 3/2012 Powell ..... E21B 34/066 166/373
2012/0255788 A1 * 10/2012 Schwefe et al. ..... 175/61
2014/0326512 A1 * 11/2014 Harms ..... E21B 34/14 175/317

FOREIGN PATENT DOCUMENTS

EP 0530045 A1 3/1993
EP 0874128 A2 10/1998
EP 1008717 A1 6/2000
EP 1348528 A2 10/2003
GB 2039567 A 8/1980
GB 2050466 A 1/1981
GB 2352464 A 1/2001
WO WO0043628 7/2000
WO 2010036834 A2 4/2010
WO WO2010042797 A2 4/2010
WO 2013188206 A1 12/2013

OTHER PUBLICATIONS

European Search Report dated Nov. 21, 2014 for International Application No. 09819931.8-1503/2340346 PCT/US2009/060133; references in PCT are cited above. (7 pages).
Canadian Office Action dated Jan. 13, 2016. Application No. 2875197. (4 pgs).
Chinese Office Action dated Feb. 3, 2016. Application No. 201380039524.5. 20 pages.
European Search Report dated Oct. 2, 2015 for International Application No. 09819931.8-1503; references in PCT are cited above. (5 pages).

* cited by examiner

DRILL BIT WITH HYDRAULICALLY ADJUSTABLE AXIAL PAD FOR CONTROLLING TORSIONAL FLUCTUATIONS

CROSS-REFERENCE TO RELATED APPLICATIONS

This application is a continuation-in-part of U.S. application Ser. No. 12/248,801, filed on Oct. 9, 2008, which issued as U.S. Pat. No. 8,205,686, which is a continuation-in-part of U.S. patent application Ser. No. 12/237,569 filed on Sep. 25, 2008, which issued as U.S. Pat. No. 7,971,662, each of which is incorporated herein in its entirety.

BACKGROUND INFORMATION

Field of the Disclosure

This disclosure relates generally to drill bits and systems that utilize the same for drilling wellbores.

Background of the Art

Oil wells (also referred to as "wellbores" or "boreholes") are drilled with a drill string that includes a tubular member having a drilling assembly (also referred to as the "bottomhole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit is attached to the bottom end of the BHA. The drill bit is rotated by rotating the drill string and/or by a drilling motor (also referred to as a "mud motor") in the BHA in order to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. It occurs a time period later, depending upon the wellbore depth.

Therefore, there is a need to provide an improved drill bit and a system for using the same for controlling drill bit fluctuations and ROP of the drill bit during drilling of a wellbore.

SUMMARY

In one aspect, a drill bit is disclosed that, in one configuration, includes one or more cutters on a surface thereon configured to penetrate into a formation, at least one pad at the surface, an actuation device configured to supply a fluid under pressure to the pad to extend the pad from the surface, and a relief device configured to drain fluid supplied to the pad to reduce the pressure on the at least one pad when the force applied on the at least one pad exceeds a selected limit.

In another aspect, a method of making a drill bit is disclosed that may include: providing a cutter and at least one pad on a surface of the drill bit, wherein the at least one pad is configured to extend from a selected position and retract from the extended position to control the fluctuations of the drill bit during drilling of a wellbore and providing a relief device configured to drain the fluid supplied to the at least one pad when the force on the at least one pad exceeds a selected limit.

In another aspect, a method of drilling a wellbore is provided that may include: (i) conveying a drill bit attached to a bottomhole assembly into the wellbore, the drill bit including a pad at a surface of the drill bit; an actuation unit configured to supply a fluid under pressure to the pad to apply a force to the pad to extend the pad from the surface; and a relief device configured to transfer fluid supplied to the pad to reduce the pressure on the pad when the force applied on the pad exceeds a selected limit; (ii) drilling the wellbore with the bottomhole assembly; and (iii) extending the pad from the surface of the drill bit during drilling of the wellbore to control fluctuations of the drill bit during drilling of the wellbore.

In yet another aspect, an apparatus for use in drilling a wellbore is disclosed that, in one configuration, may include: a drill bit attached to a bottom end of a bottomhole assembly, the drill bit including a pad, an actuation device configured to supply fluid under pressure to the pad to apply a force to the pad to extend the pad from the surface, and a relief device configured to transfer fluid supplied to the pad to reduce the pressure on the pad when the force applied on the pad exceeds a selected limit.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
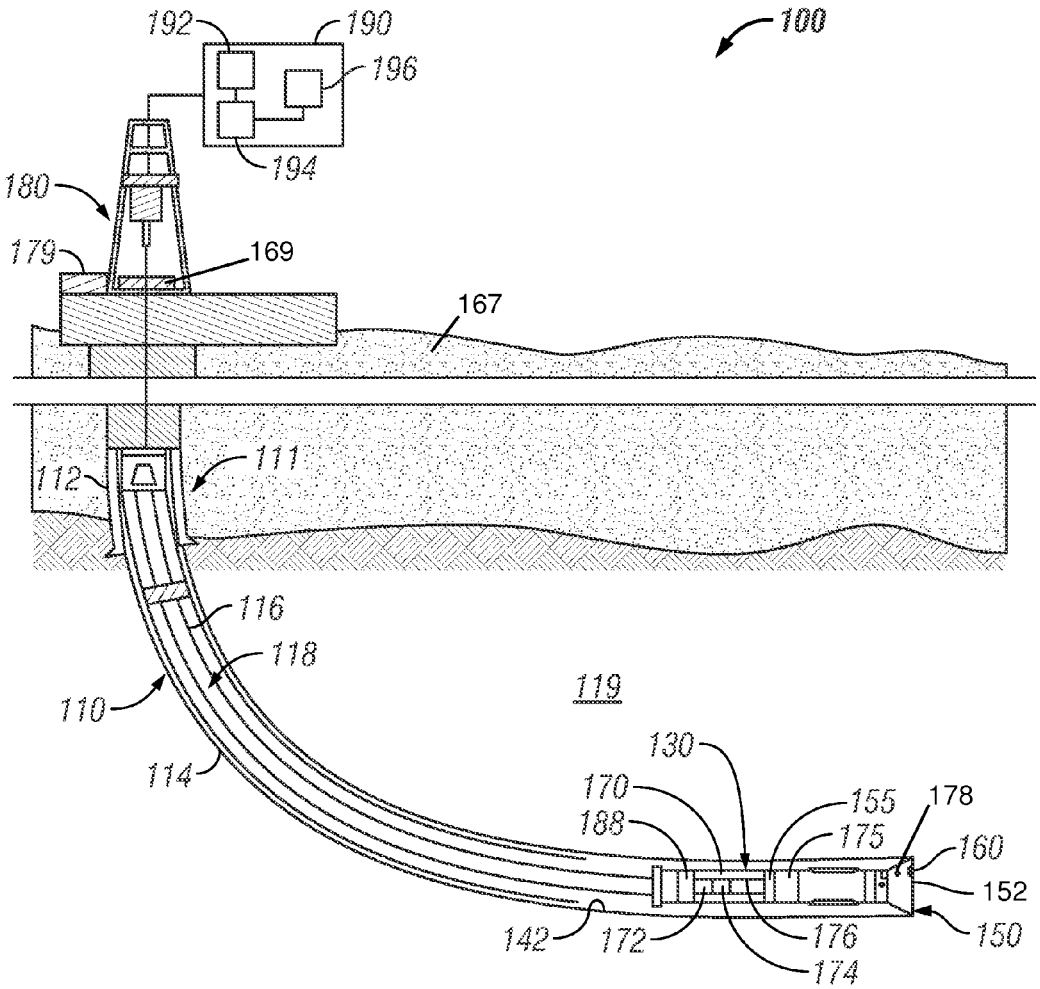
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit by the drill string 118. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150 includes a face section (or bottom section) 152. The face section 152, or a portion thereof, faces the formation in front of the drill bit or the wellbore bottom during drilling. The drill bit 150, in one aspect, includes one or more pads 160 at the face section 152 that may be adjustably (also referred to as "selectably" or "controllably") extended from the face section 152 during drilling. The pads 160 are also referred to herein as the "extensible pads," "extendable pads," or "adjustable pads." A suitable actuation device (or actuation unit) 155 in the BHA 130 and/or in the drill bit 150 may be utilized to activate the pads 160 during drilling of the wellbore 110. A suitable sensor 178 associated with the pads 160 or associated with the actuation unit 155 provides signals corresponding to the force applied on the pads or determine the pad extension. The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 configured to control the operation of the pads 160 and for at least partially processing data received from the sensors 175 and 178. The controller 170 may include, among other things, circuits to process the sensor 178 signals (e.g., amplify and digitize the signals), a processor 172 (such as a microprocessor) to process the digitized signals, a data storage device 174 (such as a solid-state-memory), and a computer program 176. The processor 172 may process the digitized signals, control the operation of the pads 160, process data from other sensors downhole, control other downhole devices and sensors, and communicate data information with the controller 190 via a two-way telemetry unit 188. In one aspect, the controller 170 may adjust the extension of the pads 160 to control the drill bit fluctuations or ROP to increase the drilling effectiveness and to extend the life of the drill bit 150. Increasing the pad extension may decrease the cutter exposure to the formation or the depth of cut of the cutter. Reducing cutter exposure may result in reducing fluctuations torsional or lateral, ROP, whirl, stick-slip, bending moment, vibration, etc., which in turn may result in drilling a smoother hole and reduced stress on the drill bit 150 and BHA 130, thereby extending the BHA and drill bit lives. For the same WOB and the RPM, the ROP is generally higher when drilling into a soft formation, such as sand, than when drilling into a hard formation, such as shale. Transitioning drilling from a soft formation to a hard formation may cause excessive lateral fluctuations because of the decrease in ROP while transitioning from a hard formation to a soft formation may cause excessive torsional fluctuations in the drill bit because of an increase in the ROP. Controlling the fluctuations of the drill bit, therefore, is desirable when transitioning from a soft formation to a hard formation or vice versa. The pad extension may be controlled based on one or more parameters, including, but not limited to, pressure, tool face, ROP, whirl, vibration, torque, bending moment, stick-slip and rock type. Automatically and selectively adjusting the pad extension enables the system 100 to control the torsional and lateral drill bit fluctuations, ROP and other physical drill bit and BHA parameters without altering the weight-on-bit or the drill bit RPM at the surface. The control of the pads 160 is described further in reference to FIGS. 2A, 2B, 3A and 3B.

Figure 2A:
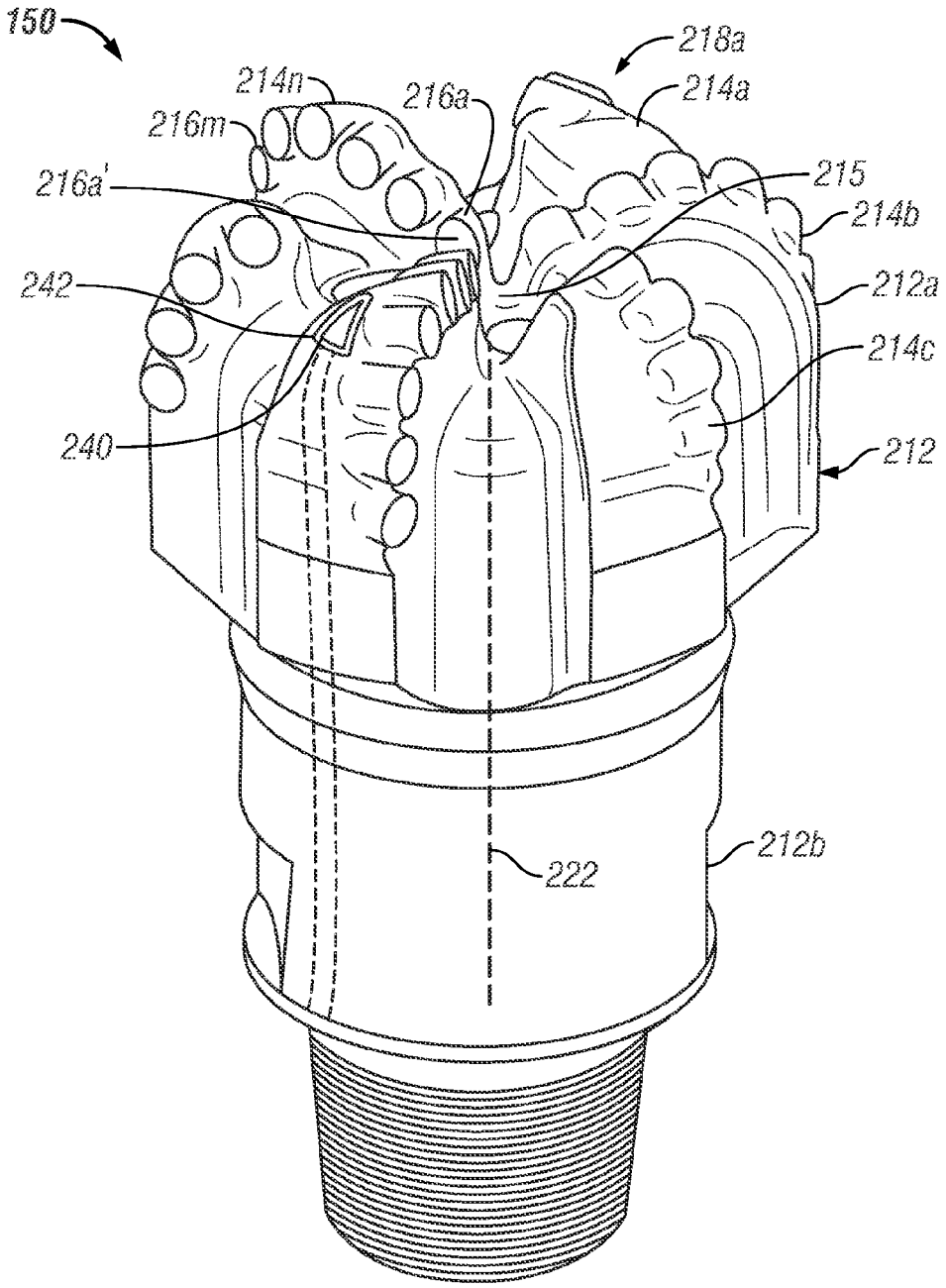
FIG. 2A is an isometric view of an exemplary drill bit showing placement of one or more adjustable pads on the drill bit according to one embodiment of the disclosure.
Figure 3A:
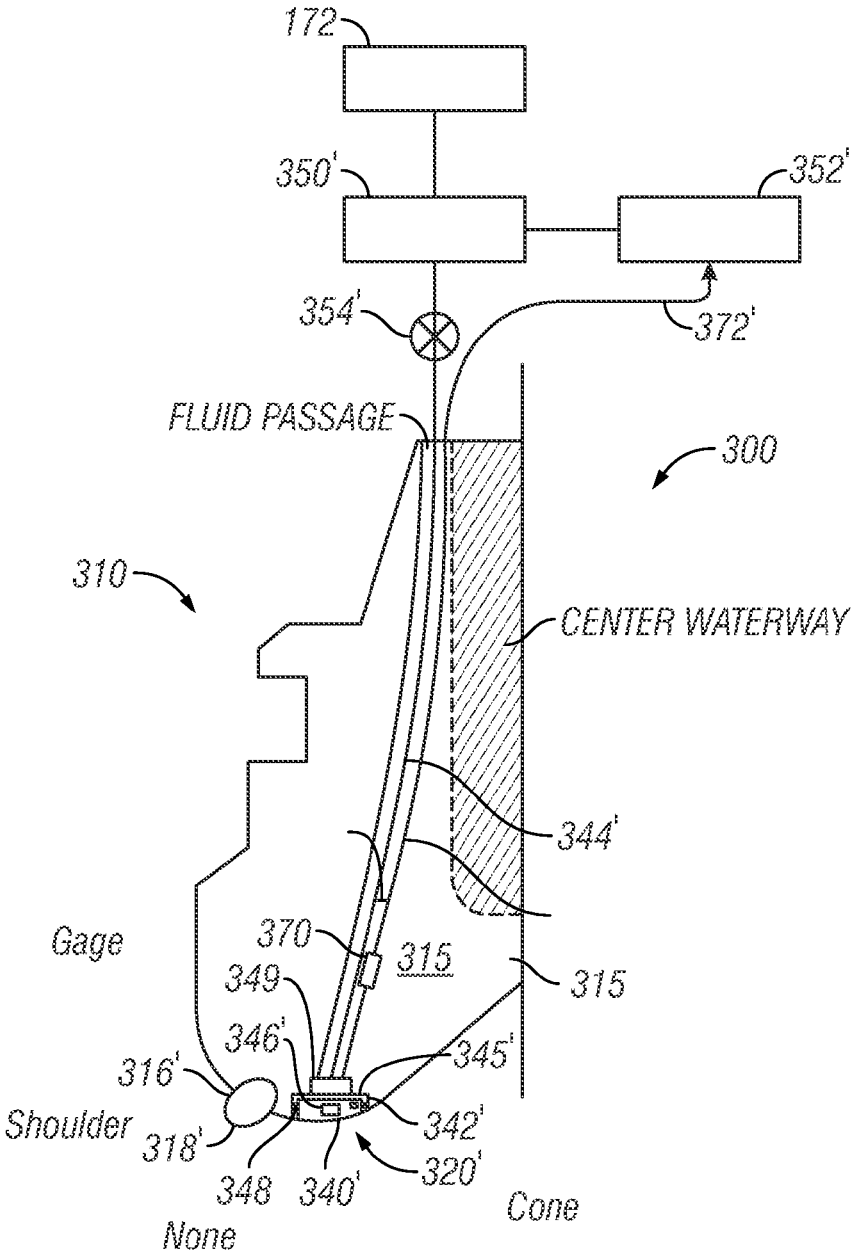
FIG. 3A shows a portion of the drill bit of FIG. 2A that includes a fluid channel in communication with an extendable pad at the face section of the drill bit and an actuation device for actuating the extendable pad according to one embodiment of the disclosure.

FIG. 2A shows an isometric view of the drill bit 150 made according to one embodiment of the disclosure. The drill bit 150 shown is a polycrystalline diamond compact (PDC) bit having a bit body 212 that includes a section 212*a* that includes cutting elements and shank 212*b* that connects to a BHA. The section 212*a* includes a face section 218*a* (also referred to herein as the "bottom section"). For the purpose of this disclosure, the face section 218*a* may comprise a nose, cone, and shoulder as shown in FIG. 3A. The section 212*a* is shown to include a number of blade profiles 214*a*, 214*b*, . . . 214*n* (also referred to as the "profiles"). Each blade profile includes cutters on the face section 218*a*. Each blade profile terminates proximate to a drill bit center 215. The center 215 faces (or is in front of) the bottom of the wellbore 110 ahead of the drill bit 150 during drilling of the wellbore. A side portion of the drill bit 150 is substantially parallel to the longitudinal axis 222 of the drill bit 150. A number of spaced-apart cutters are placed along each blade profile. For example, blade profile 214*n* is shown to contain cutters 216*a*-216*m*. Each cutter has a cutting surface or cutting element, such as cutting element 216*a*' for cutter 216*a*, that engages the rock formation when the drill bit 150 is rotated during drilling of the wellbore. Each cutter 216*a*-216*m* has a back rake angle and a side rake angle that in combination define the depth of cut of the cutter into the rock formation. Each cutter also has a maximum depth of cut into the formation.

Still referring to FIG. 2A, a number of extendable pads, such as pad 240, may be placed on the face section 218*a* of the drill bit 150. In one configuration, the pad 240 may be placed proximate to the cutters of a blade profile (214*a*-214*n*). Each pad 240 may be placed in an associated cavity 242. The pad 240 may be controllably extended from the face section 218*a* and retracted into the cavity 242. The extension of the pad 240 depends upon the force applied to the pad 240. The pad 240 retracts toward the cavity 242 when the force is released or reduced from the pad 240. In one configuration, an actuation device element 350' (FIG. 3A) may supply a fluid under pressure to the pad 240 via a fluid channel 244 associated with the pad 240 to extend the pad 240 from the face section 218*a*. A particular actuation device is described in more detail in reference to FIG. 3. A suitable biasing member may be coupled to the pad 240 to cause the pad 240 to retract.

Figure 2B:
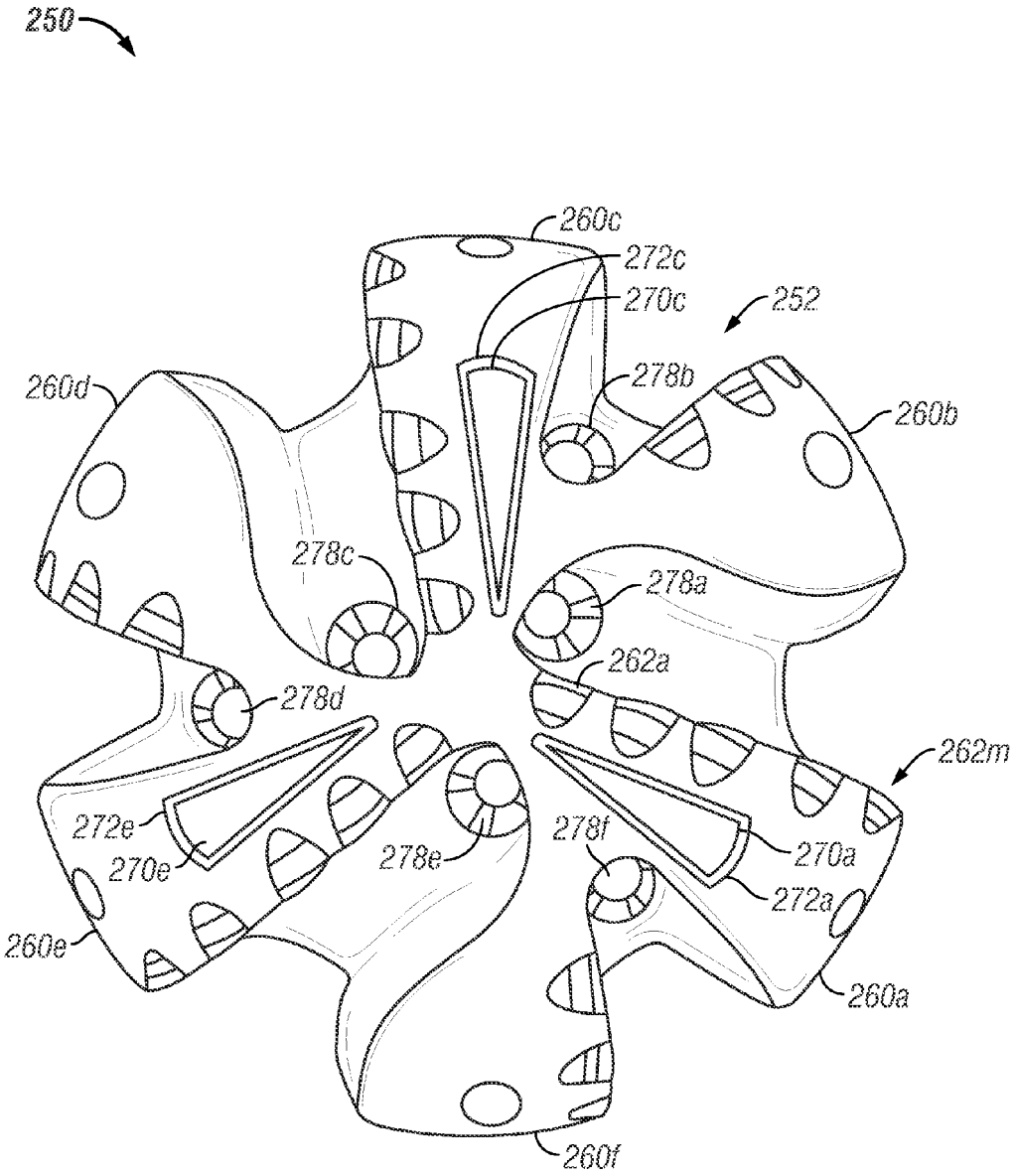
FIG. 2B shows an isometric view of the bottom section of the drill bit of FIG. 2A showing the placement of the pads according to one method of the disclosure.

FIG. 2B shows an isometric view of a face section 252 of an exemplary PDC drill bit 250. The drill bit 250 is shown to include six blade profiles 260*a*-260*f*, each blade profile including a plurality of cutters, such as cutters 262*a*-262*m* for the blade profile 260*a*. Alternate blade profiles 260*a*, 260*c* and 260*e* are shown converging toward the center 215 of the drill bit 250 while the remaining blade profiles 260*b*, 260*d* and 260*f* are shown terminating respectively at the side of blade profiles 260*c*, 260*e* and 260*a*. Fluid channels 278*a*-278*f* discharge the drilling fluid 179 (FIG. 1) to the drill bit bottom. The specific configuration of FIG. 3 shows three adjustable pads at the face section 252 of the drill bit 250, one each along an associated blade profile: pad 270*a* along blade profile 260*a*; pad 270*c* along blade profile 260*c*; and pad 270*e* along blade profile 260*e*. The pads 270*a*, 270*c* and 270*e* are shown placed in their respective cavities 272*a*, 272*c* and 272*e*. As described in reference to FIG. 2A, each pad 272*a*, 272*c* and 272*e* may be selectively extended to a desired distance from the face section 252 by applying a selected force thereon. In one configuration, all pads 270*a*, 270*c* and 270*e* may be placed in a symmetrical manner about the center 215 and may be configured to extend the same distance from the drill bit face section 252 for controlling the drill bit fluctuations or ROP. Although six blade profiles (260*a*-260*f*) and three pads are shown, the drill bit 250 may include any suitable number of blade profiles and pads (270*a*, 270*c*, 270*f*). Furthermore, the concepts shown and described herein are equally applicable to non-PDC drill bits.

FIG. 3A shows a partial side view 300 of an exemplary blade profile 310 of the drill bit 250 (FIG. 2B). The blade profile 310 is shown to include an exemplary cutter 316' placed inside of the bit body 315. The cutter 316' has a cutting element or cutting surface 318'. The cutter 316' extends a selected distance from the face section 320' of the blade profile 310. The blade profile 310 is further shown to include an extendable pad 340' proximate to the cutter 316'. The pad 340' may be placed in a compliant recess or seat 342' in the blade profile 310. Seal 348 may be provided to form a seal for the hydraulic fluid in the recess 342'. In one embodiment, a fluid under pressure from a source thereof may be supplied to the pad 340' via a fluid line or fluid channel 344' made in the blade profile 310 or at another suitable location in the drill bit body. The fluid to the pad 340' may be supplied by an actuation or power device 350' located inside or outside the drill bit 250. The fluid may be a clean fluid stored in a reservoir 352' or it may be the drilling fluid 179 (FIG. 1) supplied to the drill bit 250 during drilling of the wellbore 110 (FIG. 1). In another aspect, the fluid from the actuation device or unit 350' may be supplied to a piston 346' that moves in a chamber 349 to move the adjustable pad 340' outward (away from the surface section 320'). The actuation device 350' may be any suitable device, including, but not limited to, an electrical device, such as a motor, an electro-mechanical or hydraulic device, such as a pump driven by a motor, a hydraulic device, such as a pump driven by a fluid-driven turbine, and a mechanical device, such as a ring-type device that selectively allows a fluid to flow to the pad 340'. The fluid supplied to the pad 340' may be held under pressure to maintain the pad at a desired extension. In one configuration, the pad 340' may be held in a desired extended position by maintaining the actuation device 350' in an active mode. In another aspect, a fluid flow control device 354', such as a valve, may be associated with the extendable pad 340' to control the supply of the fluid to the pad. In one configuration, a common actuation device 350' may be utilized to supply the fluid to the each pad via a common control valve. In another configuration, a common actuation device may be utilized with a separate control valve for each pad to control the fluid supply to each of the pads. In yet another configuration, a separate actuation device with a separate control valve may be used for each pad. In another configuration, an electrical actuation unit may be utilized that moves a linear member to extend and retract the pad 340'. A sensor 345' proximate to the pad 340' may be used to provide signals representative of the amount of pad extension. The sensor may be a linear movement sensor, a pressure sensor or any other suitable sensor 345'. The processor 172 in the BHA 130 (FIG. 1) may be configured to control the operation of the actuation device 350' in response to a downhole-measured parameter, an instruction stored in the storage device 174, or an instruction sent from the surface controller 190 or an operator at the surface. The movement of the extendable pad 340' relative to fluid supplied thereto may be calibrated at the surface and the calibrated data may be stored in the data storage device 174 for use by the processor 172. When an electric motor is used to activate a linear device to move the pad 340', the amount of rotation may be used to control the pad extension. In another aspect, a device that deforms (such as a piezo-electric device) upon an application of an excitation signal may be used to extend and retract the pad 340'. The amount of excitation signal determines the deformation of the actuation device and thus the pad extension and retraction. The pad 340' retracts upon the release of the excitation signal. In another aspect, a check valve 370 may be provided between the chamber 349 and the reservoir 352' via a fluid line 372'. The check valve 370 may be configured to open at a selected high pressure so as to drain or bleed the fluid supplied to the pad 340' to the reservoir when the pressure applied to the pad 340' exceeds a selected limit to avoid damage to the pad 340'.

Figure 3B:
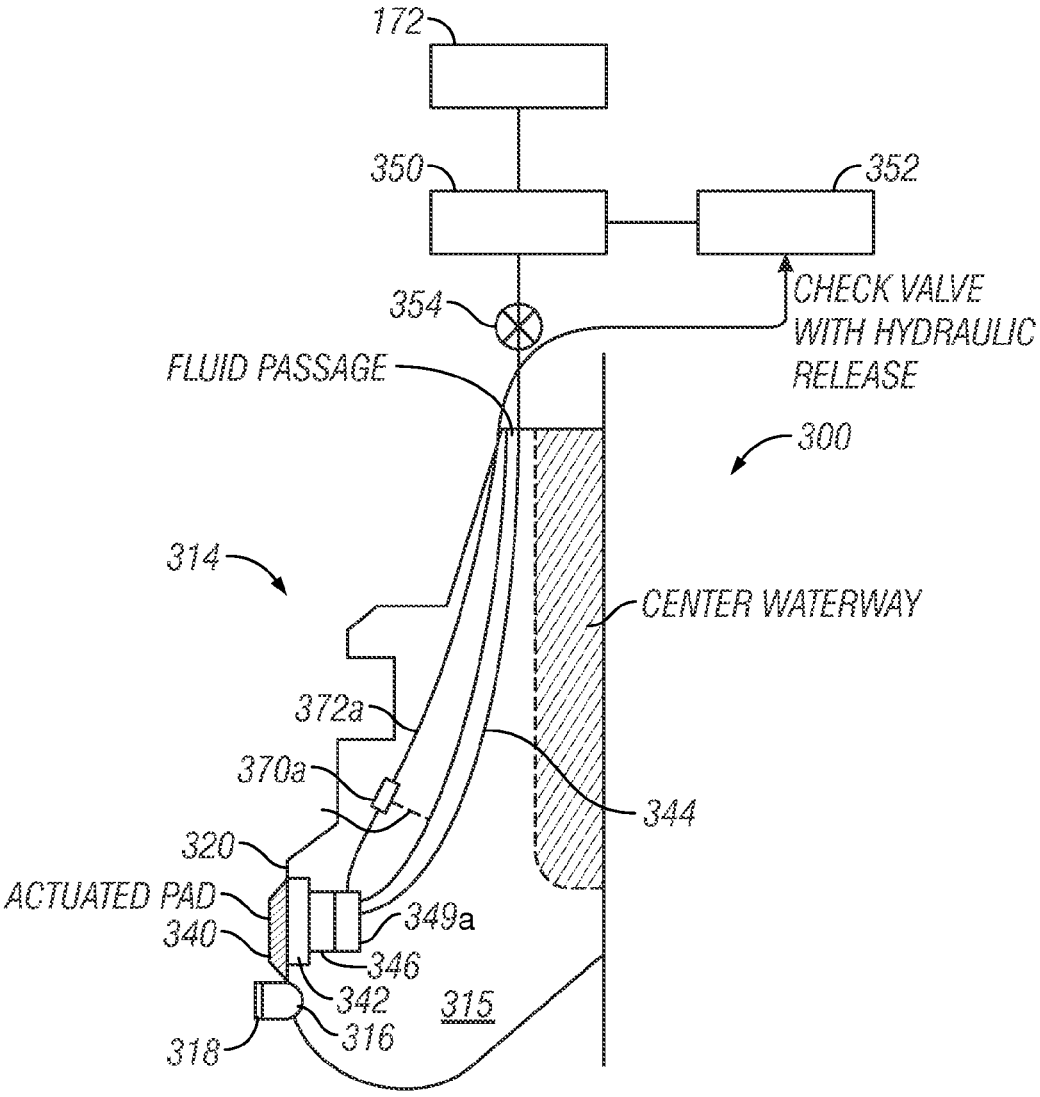
FIG. 3B shows a portion of the drill bit of FIG. 2A that includes a fluid channel in communication with a an extendable pad at a side of the drill bit and an actuation device for actuating the extendable pad according to one embodiment of the disclosure.
Figure 3C:
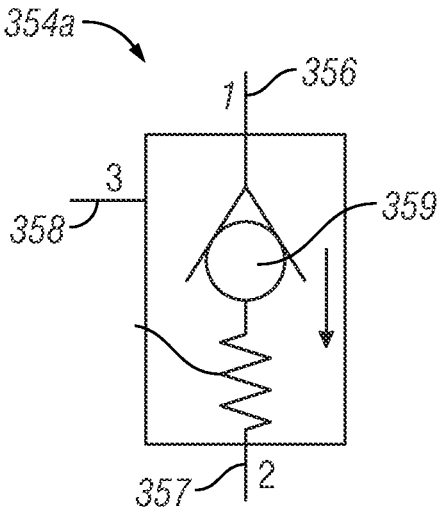
FIG. 3C shows an exemplary check valve with a relief mechanism that may be used as the fluid flow control device in the systems shown in FIGS. 3A and 3B.

FIG. 3B shows a partial side view 300 of an exemplary blade profile 314. The blade profile 314 is shown to include a cutter 316 placed on the side section 320 of the blade body 315. The cutter 316 has a cutting element or cutting surface 318. The cutter 316 extends a selected distance from the side 320 of the blade profile 314. The blade profile 314 also is shown to include an extendable pad 340 proximate to the cutter 316. The extendable pad 340 may be placed in a compliant recess or seat 342 in the blade profile body 315. In one embodiment, fluid under pressure from a source thereof may be supplied to the extendable pad 340 via a fluid line or fluid channel 344 made in the blade profile 315 or at another suitable location in the bit body. The fluid to the extendable pad 340 may be supplied by an actuation or power device 350 located inside or outside the drill bit 150. The fluid may be a clean fluid stored in reservoir 352 or it may be the drilling fluid 179 (FIG. 1) supplied to the drill bit 150 during drilling of the wellbore 110 (FIG. 1). In another aspect, the fluid from the actuation unit 350 may be supplied to a piston 346 that moves the extendable or adjustable pad 340 outward (away from the blade profile 315). The actuation device 350 may be any suitable device, including, but not limited to, an electrical device, such as a motor, an electro-mechanical device, such as a pump driven by a motor, a hydraulic device, such as a pump driven by a turbine operated by the fluid flowing in the BHA, and a mechanical device, such as a ring-type device that selectively allows a fluid to flow to the pad 340. The fluid supplied to the extendable pad 340 is held under pressure while the extendable pad 340 is on the low side of the wellbore 110. In one configuration, the extendable pad 340 may be held in a desired extended position by maintaining the actuation device 350 in an active mode. In another aspect, a fluid flow control device 354, such as a valve, may be associated with each adjustable pad to control the supply of the fluid to its associated pad. In such a configuration, a common actuation device 350 may be utilized to supply the fluid to all the control valves. In another configuration, a separate actuation device may be utilized to control the fluid supply to each of the pads 340. The processor 172 in the BHA (FIG. 1) may be configured to control the operation of the actuation device 350 in response to a downhole-measured parameter or an instruction stored in the storage device 174 or an instruction sent from the surface controller 190. The movement of the adjustable pad 340 relative to fluid supplied thereto may be calibrated at the surface and the calibrated data may be stored in the data storage device 174 for use by the processor 172. In one aspect some of some components that are used to activate the pad 340 on the side of the blade and the pads 340' on the face section may be common. For example, a common actuation device with different control valves may be utilized for activating the side pad 340 and bottom pads 340'. Thus, in one embodiment, an adjustable pad, such as pad 340, on the side of a blade profile and one or more pads, such as pads 340' on the face section of a drill bit may be utilized. The side pad 340 may be used to alter the direction of the drill bit 150, while the pads 340' on the face section 320 may be used to control the ROP downhole. In another aspect, a check valve 370*a* may be provided between the chamber 349 and the reservoir 352 via a fluid line 372*a*. The check valve 370*a* may be configured to open at a selected high pressure so as to drain the fluid supplied to the pad 340 to the reservoir when the pressure applied to the pad 340 exceeds a selected limit to avoid damage to the pad 340. In either of the configurations shown in FIGS. 3A and 3B, the flow control device 354 or 354' may be a check valve with a hydraulic relief, such as a valve 354*a* shown in FIG. 3C. When the fluid under pressure is supplied to the valve 354*a* along the entry path 356, the valve opens and allows the fluid to exit outlet path 357. When the pressure at entry path 356 is relieved, the fluid from the path 357 enters the valve 354*a* and exits via the relief path or bypass 358. Such a valve controllably allows the pad 340 to extend and retract from the drill bit surface. As noted earlier, the controller in the drill bit, bottomhole assembly and/or at the surface may be programmed to control the extension and retraction of the pad based on one or more selected criteria or parameters.

Figure 4:
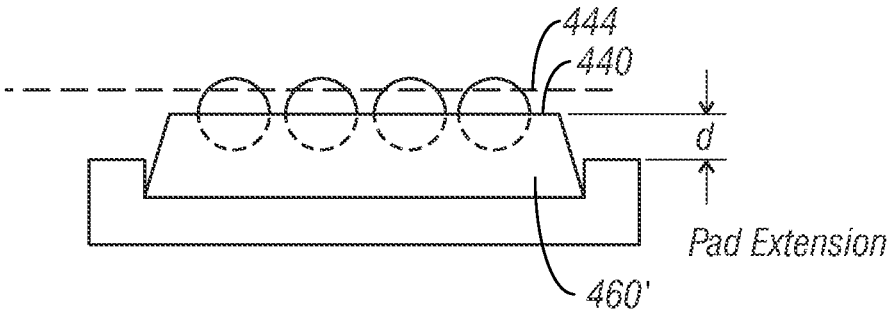
FIG. 4 is a schematic diagram showing an extendable pad in an extended position relative to cutting elements on the face section of the drill bit of FIG. 2A.

FIG. 4 shows an extendable pad 440 in an extended position. The pad 440 extension may be adjusted by the amount of the force applied to the pad 440. The extendable pad 440 is shown extended by a distance "d" and may be extended to a maximum or full extended position as shown by the dotted line 444. The pad 440 remains at its selected or desired extended position until the force applied to the pad 440 is reduced or removed by the actuation device. For example, in the configuration shown in FIG. 3A, closing the valve 354' or holding the actuation device 350' in a manner that prevents the fluid supplied to the pad 440 from returning to the fluid storage device 352' will cause the pad 440' to remain in the selected extended position. When the valve 354' is opened or the actuation device 350' is deactivated, little or no force is applied to the extendable pad 340'. The lack of force enables the pad 340' to retract or retreat from the extended position. A biasing member 460' also may be provided for each pad 440 to cause the pad 440 to retract when the force on the pad 440 reduced or removed.

Referring to FIGS. 1-4, in operation, the pad extension may controlled based on the desired impact on the rate of penetration of the drill bit into the earth formation and/or a property of the drill bit 150 or the BHA 130. The pad extension may be controlled based on any one or more desired parameters, including, but not limited to, vibration, drill bit lateral or torsional fluctuations, ROP, pressure, tool face, rock type, vibration, whirl, bending moment, stick-slip, torque and drilling direction. In general, however, the greater the pad extension, the greater the reduction in the ROP of the drill bit into the formation. A drill bit made according to any of the embodiments described herein may be employed to reduces the depth of cut by the cutters at the face section of the drill bit, which in turn affects the drill bit fluctuations and ROP. Reduction in the drill bit fluctuations (torsional or lateral) may affect one or more of the drill bit and/or BHA physical parameters. The relationship between the applied force and the pad extension may be obtained in laboratory test. The calculated or otherwise determined (such as through modeling) relationship among the applied force, pad extension, the corresponding change in drill bit fluctuations, ROP, and the impact on any other parameter may be stored in the downhole data storage device 274 and/or the surface data storage device 194. Such information may be stored in any suitable form, including, but not limited to, one or more algorithms, curves, matrices, and tables. The pad extension may be controlled by the downhole controller 270 and/or by the surface controller 190. The system 100 provided herein may automatically and dynamically control the pad extensions and thus the drill bit fluctuations, ROP and other parameters during drilling of the wellbore 110 without changing certain other parameters, such as the WOB and RPM. The extension of the pad 340 (FIG. 3B) on the side of the drill bit may be controlled in the same manner as the pad 340' (FIG. 3A) on the face section, based on any desired parameters, to alter the drilling direction. The side pad, such as pad 340, and the pads on the face section, such as pads 340' may be activated concurrently so as to alter the drilling direction and the ROP substantially simultaneously.

Thus, in one aspect, a drill bit is disclosed that in one configuration may include a face section or bottom face that includes one or more cutters thereon configured to penetrate into an earth formation and a number of selectively extendable pads to control drill bit fluctuations or ROP of the drill bit into the earth formation during drilling of a wellbore. In one aspect, each pad may be configured to extend from the face section upon application of a force thereon. The pad retracts toward the face section when the force is reduced or removed. Each pad may be placed in an associated cavity in the drill bit. A biasing member may be provided for each pad that cause the pad to retreat when the force applied to the pad is reduced or removed. The biasing member may be directly coupled or attached to the pad. Any suitable biasing member may be used, including, but not limited to, a spring. The force to each pad may be provided by any suitable actuation device, including, but not limited to, a device that supplies a fluid under pressure to the pad or to a piston that moves the pad, and a shape-changing device or material that changes its shape or deforms in response to an excitation signals. The shape-changing device returns to its original shape upon the removal of the excitation. The amount of the change in the shape depends on the amount of the excitation signal. The device that supplies fluid under pressure may be a pump operated by an electric motor or a turbine operated by the drilling fluid. The fluid may be a clean fluid (such as an oil) stored in a storage chamber in the BHA or it may be the drilling fluid. A fluid channel from the pump to each pad may supply the fluid. In another configuration, the fluid may be supplied to a piston attached to the pad. The resulting piston movement extends the pad. A control valve may be provided to control the fluid into the fluid channels or to the pistons. In one aspect, all pads may be extended to the same extension or distance from the bottom section. A common actuation device and control valve may be used.

In another aspect, a method of making a drill bit is disclosed which method includes: providing a plurality of blade profiles terminating at a bottom section of the drill bit, each blade profile having at least one cutter thereon; and placing a plurality of extendable pads at the bottom section of the drill bit, wherein each extendable pad is configured to extend to a selected distance from the bottom section upon application of a force and retract toward the bottom section upon the removal of the force on the extendable pad. The method may further include placing each extendable pad in an associated cavity in the drill bit bottom section. The method may further include coupling a biasing member to each extendable pad. The biasing member is configured to retract its associated pad upon the removal of the force applied to the pad. One or more fluid channels may supply a fluid under pressure to the pads to cause the pads to extend to respective selected positions. The method may further include providing an actuation device that supplies the force to each pad in the plurality of pads. The actuation device may include at least one of: a device that supplies fluid under pressure to each pad; and a shape-changing device or material that deforms in response to an excitation signal.

In another aspect, a BHA for use in drilling a wellbore is disclosed that, in one configuration, may include a drill bit attached to a bottom end of the BHA, the drill bit including a bottom section that includes one or more cutters thereon configured to penetrate into a formation. The drill bit may also include a plurality of extendable pads at the bottom section; and an actuation unit that is configured to apply force to each pad to extend each pad to a selected extension. The extension results in altering the drill bit fluctuations and ROP of the drill bit into the earth formation during drilling of the wellbore. The actuation unit may be one of a power unit that supplies fluid under pressure to each pad and a shape-changing material that supplies a selected force on each pad upon application of an activation signal to the shape-changing device or material. The BHA may further include a sensor that provides signals relating to the extension of each pad or the force applied by the actuation device on each of the pads. In another aspect, the BHA may further include a controller configured to process signals from the sensor to control the extensions of the pads. The controller may control the pad extensions based on one or more parameters, which parameters may include, but are not limited to, drill bit fluctuations (lateral and/or torsional), weight-on-bit, pressure, ROP (desired or actual), whirl, vibration, bending moment, and stick-slip. A surface controller may be utilized to provide information and instructions to the controller in the BHA.

In yet another aspect, a method of forming a wellbore may include: conveying a drill bit attached to a bottomhole assembly into the wellbore, the drill bit having at least one cutter and at least one pad on a face section of the drill bit; drilling the wellbore by rotating the drill bit; applying a force on the at least one pad to move the at least one pad from a retracted position to a selected extended position and reducing the applied selected force on the at least one pad to cause the at least one pad to retract from the selected extended position to control fluctuations of the drill bit during drilling of the wellbore.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a surface that includes one or more cutters thereon configured to penetrate into a formation;

at least one pad at the surface;

a fluid channel that extends between a reservoir and the at least one pad, the reservoir having a clean hydraulic fluid;

an actuation unit in the fluid channel configured to pump the hydraulic fluid from the reservoir to the at least one pad through the fluid channel to extend and retract the at least one pad from the surface;

a relief path that extends between the at least one pad and the reservoir of clean hydraulic fluid; and a check valve in the relief path configured to transfer fluid at the at least one pad through the relief path to the reservoir to reduce the pressure on the at least one pad when a hydraulic pressure applied on the check valve exceeds a selected limit, wherein the check valve is forced from a closed position to an open position by the hydraulic pressure applied to the check valve.

2. The drill bit of claim 1, wherein the at least one pad comprises a plurality of extendable pads and wherein the actuation unit extends each extendable pad to substantially the same extension.

3. The drill bit of claim 1, wherein the at least one pad is placed in a cavity in the drill bit.

4. The drill bit of claim 2 further comprising a biasing member coupled to the at least one extendable pad that causes the at least one pad to retract when the force applied to the pad is reduced.

5. The drill bit of claim 1 further comprising a fluid channel configured to supply the fluid under pressure to cause the at least one pad to extend to the selected position.

6. The drill bit of claim 1, wherein the actuation unit includes at least one o£ a power unit that supplies fluid under pressure to the at least one pad; and controller that controls the supply of the fluid.

7. The drill bit of claim 1 further comprising a check valve with a hydraulic release between the actuation device and the at least one pad to control the supply of the fluid to the at least one pad.

8. The drill bit of claim 5, wherein the fluid channel is located as one of: outside a main fluid channel in the drill bit; and at least partially inside the main fluid channel in the drill bit.

9. A method of drilling a wellbore, comprising:

conveying a drill bit attached to a bottomhole assembly into the wellbore, the drill bit including at least one pad at a surface of the drill bit; a fluid channel that extends between a reservoir having a clean hydraulic fluid and the at least one pad; an actuation device in the fluid channel configured to pump the clean fluid from the reservoir to the at least one pad to apply a force to the at least one pad to extend and retract the at least one pad from the surface; a relief path that extends between the at least one pad and the reservoir of clean hydraulic fluid; and a check valve in the relief path configured to transfer fluid at the at least one pad through the relief path to the reservoir to reduce the pressure on the pad when a hydraulic pressure applied on the check valve exceeds a selected limit, wherein the check valve is forced from a closed position to an open position by the hydraulic pressure applied to the check valve; and drilling the wellbore with the bottomhole assembly; and extending and retracting the at least one pad from the surface of the drill bit during drilling of the wellbore to control fluctuation of the drill bit during drilling of the wellbore.

10. The method of claim 9, wherein the at least one pad comprises a plurality of pads and wherein the method further comprises extending each pad to substantially the same extension.

11. The method of claim 9 further comprising coupling a biasing member to the at least one pad to cause the at least one pad to retract when the applied force is reduced.

12. The method of claim 9, wherein applying the force comprises using an actuation device includes at least one of: a power unit that supplies fluid under pressure to the at least one pad; and controller that controls the supply of the fluid to the at least one pad.

13. The method of claim 9 further comprising controlling the applied force in response to a selected parameter relating the drilling of the wellbore.

14. The method of claim 13, wherein the selected parameter is selected from a group consisting of; (i) vibration; (ii) stick-slip; (iii) weight-on-bit; (iv) rate of penetration of the drill bit; (v) bending moment; (vi) axial acceleration; (vii) radial acceleration; and (viii) drill bit fluctuations.

15. The method of claim 9 further comprising extending the at least one pad when drilling transitions from a soft formation to a hard formation or from a hard formation to a soft formation.

16. An apparatus for use in drilling a wellbore, comprising:

a drill bit attached to a bottom end of a bottomhole assembly, the drill bit having a surface that includes one or more cutters and at least one pad; a fluid channel that extends between a reservoir having a clean hydraulic fluid and the at least one pad; and an actuation unit in the fluid channel configured to pump clean hydraulic fluid from the reservoir to the at least one pad through the fluid channel to apply a hydraulic pressure to the at least one pad to extend and retract the at least one pad from the surface;

a relief path that extends between the at least one pad and the reservoir of clean hydraulic fluid; and a check valve in the relief path configured to transfer the fluid at the at least one pad through the relief path to the reservoir to reduce the pressure on the at least one pad when the hydraulic pressure applied on the check valve exceeds a selected limit, wherein the check valve is forced from a closed position to an open position by the hydraulic pressure applied to the check valve.

17. The apparatus of claim 16 further comprising a controller configured to control the actuation device to control the selected extension of the pad to control fluctuations in the drill bit during drilling of a wellbore.

18. The apparatus of claim 17, wherein the controller is further configured to control the actuation device in response to a parameter that is selected from a group consisting of: (i) vibration; (ii) stick-slip; (iii) weight-on-bit; (iv) rate of penetration of the drill bit; (v) bending moment; (vi) axial acceleration; (vii) radial acceleration; and (viii) drill bit fluctuations.

19. The apparatus of claim 16, wherein the actuation device includes a power unit that supplies fluid under pressure to cause the at least one pad to extend.

20. The apparatus of 16 further comprising a sensor that provides signals relating to the force applied by the actuation device on the at least one pad.

21. The apparatus of claim 16, wherein the at least one pad comprises a plurality of pads and wherein the actuation device applies substantially the same force to each of the pads in the plurality of pads.

* * * * *